US010252883B2

(12) United States Patent
Kleine, Jr. et al.

(10) Patent No.: US 10,252,883 B2
(45) Date of Patent: Apr. 9, 2019

(54) ELEVATOR HOISTWAY ACCESS SAFETY

(71) Applicant: Otis Elevator Company, Farmington, CT (US)

(72) Inventors: John F. Kleine, Jr., Florence, SC (US); Kenneth P. Litteral, Florence, SC (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 33 days.

(21) Appl. No.: 15/355,261

(22) Filed: Nov. 18, 2016

(65) Prior Publication Data

US 2017/0137258 A1 May 18, 2017

Related U.S. Application Data

(60) Provisional application No. 62/257,024, filed on Nov. 18, 2015.

(51) Int. Cl.
*B66B 5/00* (2006.01)
*B66B 9/00* (2006.01)

(52) U.S. Cl.
CPC ..... *B66B 5/0087* (2013.01); *B66B 5/005* (2013.01); *B66B 9/00* (2013.01)

(58) Field of Classification Search
CPC ..... B66B 5/0087
USPC ..... 187/247
See application file for complete search history.

(56) References Cited

U.S. PATENT DOCUMENTS 2,157,930 A * 5/1939 Vanderzee ..... B66B 13/20 187/280
5,644,111 A 7/1997 Cerny et al.
9,695,015 B1 * 7/2017 Marinelli ..... B66B 13/16
2005/0034931 A1 * 2/2005 Deplazes ..... B66B 13/125 187/313
2008/0047783 A1 2/2008 Vogl
2010/0059318 A1 * 3/2010 Ueda ..... B66B 13/14 187/316
2010/0270109 A1 * 10/2010 McCarthy ..... B66B 13/22 187/247
2011/0272216 A1 * 11/2011 Kugiya ..... B66B 5/0031 187/301
2012/0168258 A1 * 7/2012 Viita-Aho ..... B66B 5/0031 187/280
2013/0213745 A1 * 8/2013 Kattainen ..... H02P 3/02 187/288
2016/0018805 A1 * 1/2016 Kuoppala ..... G05B 15/02 700/275
2017/0137258 A1 * 5/2017 Kleine, Jr. ..... B66B 5/0087

OTHER PUBLICATIONS

European Search Report for application EP 162756166.3, dated Jun. 6, 2017, 8 pages.

* cited by examiner

*Primary Examiner* — David Warren
(74) *Attorney, Agent, or Firm* — Cantor Colburn LLP

(57) ABSTRACT

A method of controlling movement of an elevator car including determining whether the elevator car is present at a specified landing, determining a door lock state, and entering an access detection mode based in part on whether the elevator car is present at the specified landing and the door lock state.

13 Claims, 3 Drawing Sheets

ELEVATOR HOISTWAY ACCESS SAFETY

CROSS-REFERENCE TO RELATED APPLICATIONS

The present application is a nonprovisional patent application, which claims priority to 62/257,024, filed Nov. 18, 2015, which is herein incorporated in its entirety.

TECHNICAL FIELD OF THE DISCLOSED EMBODIMENTS

The present disclosure is generally related to elevator systems and, more specifically, controlling movement of an elevator car for hoistway access.

BACKGROUND OF THE DISCLOSED EMBODIMENTS

Generally, elevator mechanics endure risks associated with the maintenance and installation of elevator systems due to unexpected movement of the elevator car. There is therefore a need to prevent movement of an elevator car while the elevator mechanic performs maintenance.

SUMMARY OF THE DISCLOSED EMBODIMENTS

In one aspect, a method of controlling movement of an elevator car is provided. The method includes determining whether the elevator car is present at a specified landing, determining a door lock state, and entering an access detection mode based in part on whether the elevator car is present at the specified landing and the door lock state.

In an embodiment of the method, determining whether the elevator car is present at a specified landing includes operating an elevator drive to receive a position signal from a landing switch.

In any embodiment of the method, determining a door lock state includes determining whether a door lock mechanism has been engaged for a pre-determined duration of time. In one embodiment the pre-determined duration of time is greater than or equal to approximately 4 seconds.

In any embodiment of the method entering an access detection mode includes operating the elevator drive to prevent movement of the elevator car if the door lock mechanism has been engaged for the pre-determined duration of time and the elevator drive receives a position signal from the landing switch indicating the car is away from the specified landing.

In any embodiment, the access detection mode may not be disabled. In any embodiment, the access detection mode includes operating the elevator car at an inspection speed.

In one aspect, an elevator system is provided. The elevator system includes an elevator hoistway including a one landing, a landing switch disposed within the elevator hoistway and located in close proximity to the landing, wherein the landing switch is configured to transmit a position signal, a hoistway door located at each of the landings, a door lock mechanism operably coupled to the hoistway door, wherein the door lock mechanism is configured to transmit a door lock state signal, an elevator car disposed within the elevator shaft, the elevator car configured to travel within the elevator hoistway, and an elevator drive in communication with the elevator car, the elevator drive configured to enter an access detection mode based in part on the position signal and the door lock state signal.

In any embodiment of the elevator system, the position signal is indicative of the presence of the elevator car at the one landing.

In any embodiment of the elevator system, the door lock state signal is indicative of whether the door lock mechanism has been engaged for a pre-determined duration of time. In one embodiment, the pre-determine duration of time is greater than or equal to approximately 4 seconds.

In any embodiment of the elevator system, the hoistway door further includes an aperture disposed therein, wherein the aperture is located adjacent to the door lock mechanism. In any embodiment of the elevator system, the access detection mode may not be disabled. In any embodiment of the elevator system, the access detection mode includes operating the elevator car at an inspection speed.

Other embodiments are also disclosed.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
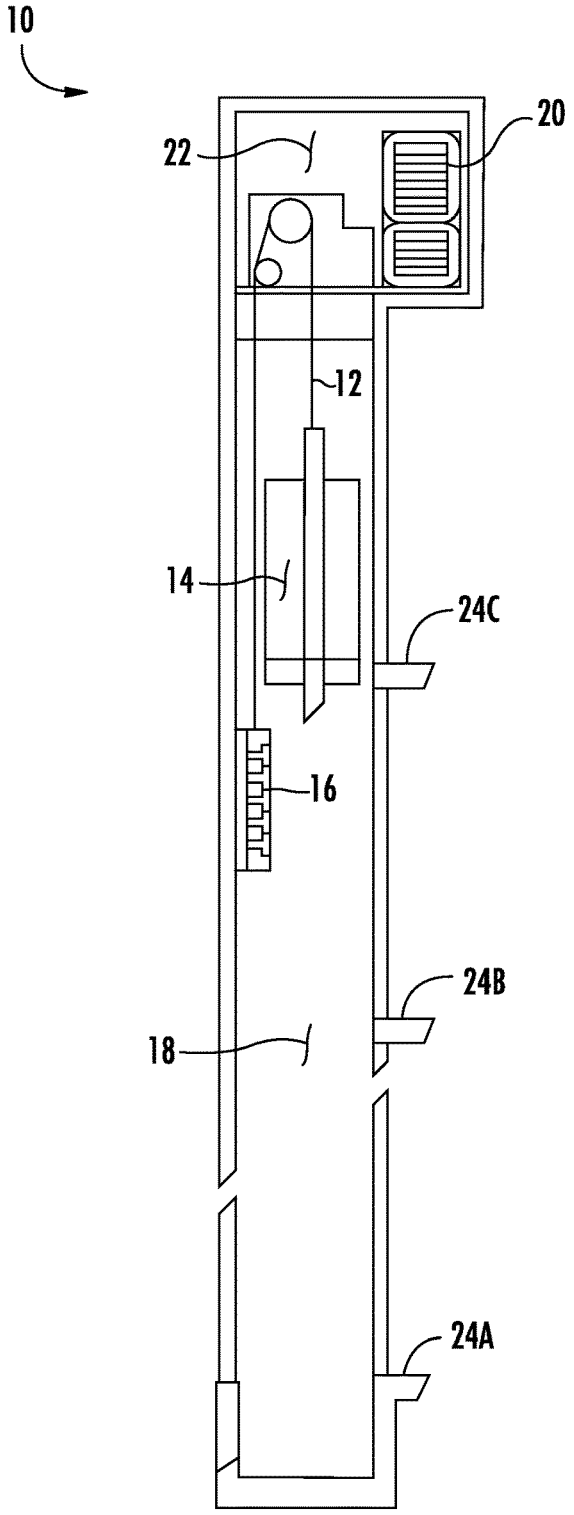
FIG. 1 is a schematic diagram of an elevator system according to an embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates an elevator system, generally indicated at 10. The elevator system 10 includes cables or belts 12, and an elevator car 14. Cables 12 are connected to the elevator car 14 and a counterweight 16 inside a hoistway 18. The car 14 moves up and down the hoistway 18 by force transmitted through cables 12 to the elevator car 14 by an elevator drive 20 commonly located in a machine room 22 at the top of the hoistway 18. The elevator system 10 is configured to stop at a plurality of landings 24A-C to allow passengers to enter and exit the elevator car 14 via a set of hoistway doors 15 (e.g., doors 15A at landing 24A shown in FIG. 2) located at the respective landings 24A-C.

Figure 2:
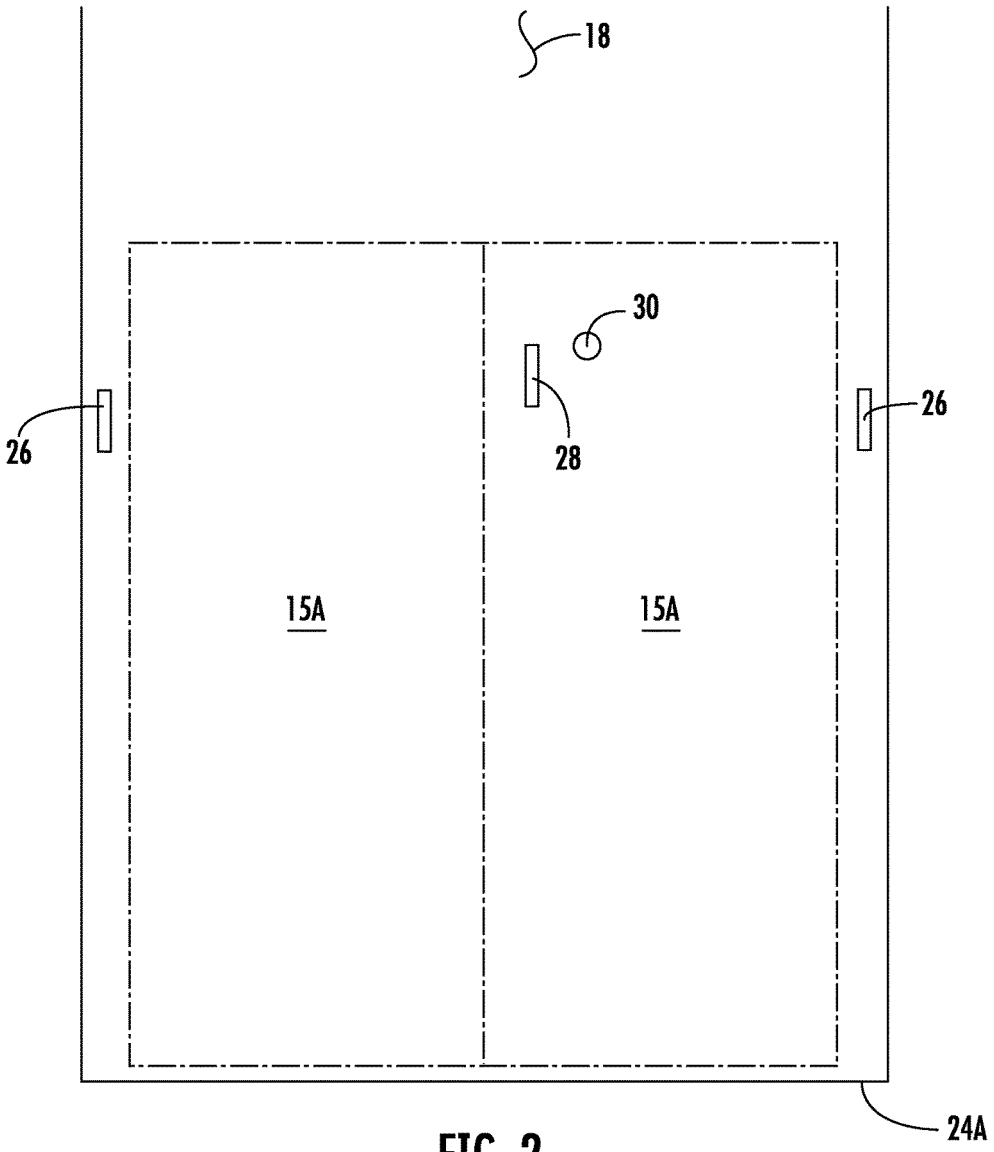
FIG. 2 is a schematic diagram of an elevator hoistway according to an embodiment of the present disclosure.

As shown in FIG. 2, a landing switch 26 is positioned within the hoistway 18 in close proximity to the landing 24A. The landing switch 26 is configured to transmit a position signal to the elevator drive 20 indicating that the elevator car 14 is positioned at a specified landing (e.g., landing 24A). It will be appreciated that the landing switch 26 may be located at the lowest landing (e.g. landing 24A) or any designated landing. It will further be appreciated that the landing switch 26 may be an electrical-mechanical switch or sensing device that provides a constant voltage signal to the elevator drive 20 when the elevator car 12 is present at a specified landing.

A door lock mechanism 28 is disposed on the hoistway door 15 and is configured to transmit a door state signal to the elevator drive 20 indicating the position of hoistway door 15 (e.g., open or closed). The door lock mechanism 28 may be engaged by the elevator mechanic via inserting an unlocking device, for example an elevator drop key, into an aperture 30 located on the hoistway door 15 adjacent to the door lock mechanism 28. As such, the elevator mechanic may unlock and open the hoistway doors 15 to gain access to the elevator pit or the top of the elevator car 12.

Figure 3:
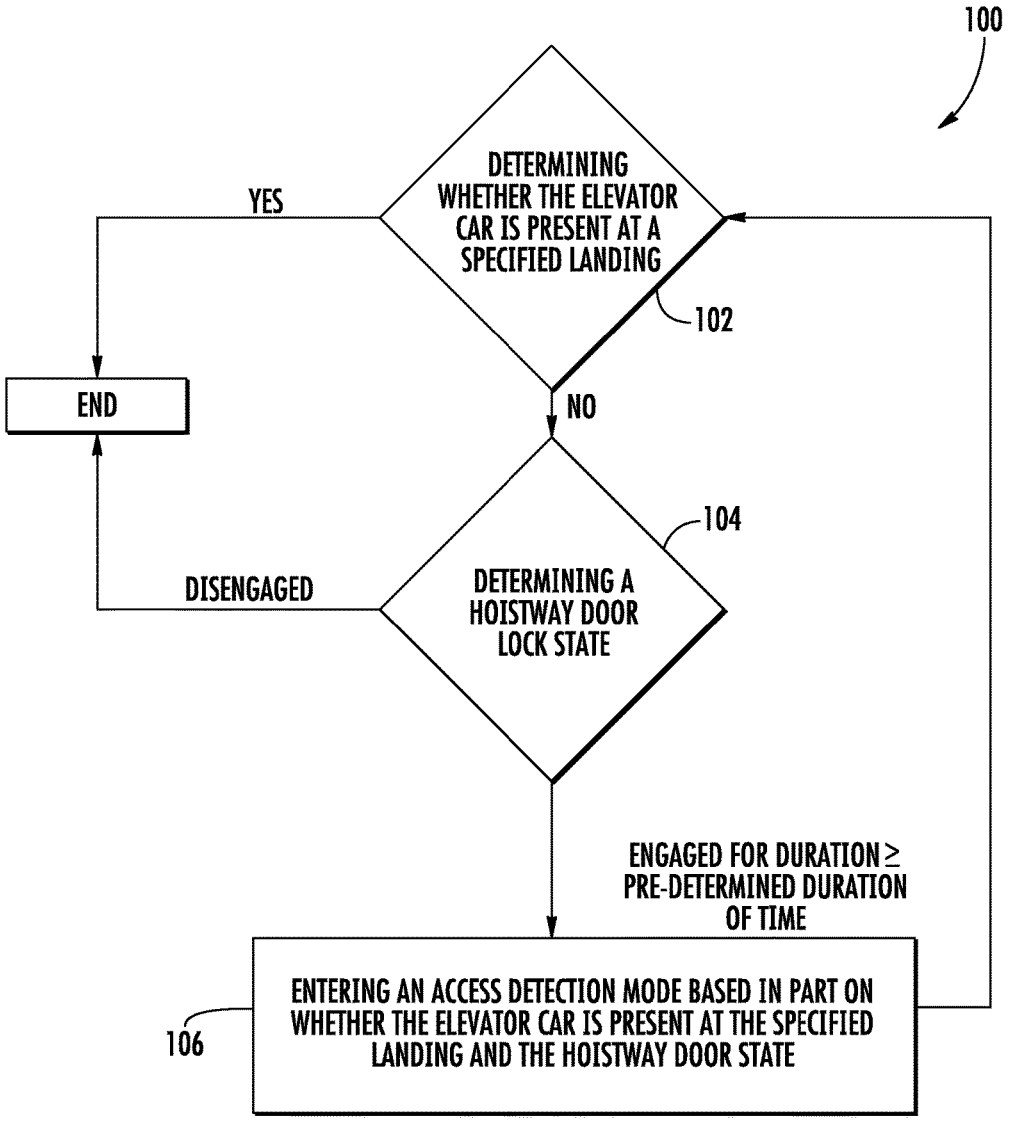
FIG. 3 is schematic flow diagram of a method of performing safe access to an elevator hoistway according to an embodiment of the present disclosure.

FIG. 3 illustrates a method for safely controlling movement of an elevator car 12 during service, the method generally indicated at 100. The method includes step 102 of determining whether the elevator car 12 is present at a specified landing. In an embodiment, determining whether the elevator car 12 is present at a specified landing includes operating the elevator drive 20 to receive a position signal from the landing switch 26.

For example, if the elevator car 12 is present at landing 24A, the landing switch 26 may transmit a signal to the elevator drive 20 indicating that the elevator car 12 is present. If the elevator car 12 is not present at landing 24A, the landing switch 26 may transmit the position signal to the elevator drive 20 indicating that the elevator car 12 is away from landing 24A. It will be appreciated that in some embodiments the landing switch 26 may transmit the position signal to the elevator drive 20 by removing a constant voltage signal from the elevator drive 20 when the elevator car is away from landing 24A.

The method further includes step 104 of determining a hoistway door state. In an embodiment, determining a hoistway door state includes determining whether the door lock mechanism 28 has been engaged for a pre-determined duration of time. In an embodiment, the pre-determined duration of time is greater than or equal to approximately 4 seconds. It will be appreciated that other pre-determined durations of time may be used in other embodiments.

For example, as the elevator mechanic attempts to gain access to either the pit or the top of the elevator car 12, the elevator mechanic inserts an elevator drop key within the aperture 30 to engage the door lock mechanism 28. The door lock mechanism 28 transmits a door lock signal to the elevator drive 20 indicating that the hoistway doors 15 have been unlocked, and potentially opened.

The method further includes step 106 of entering an access detection mode based in part on whether the elevator car 12 is present at the specified landing and the hoistway door state. In an embodiment, the access detection mode includes operating the elevator drive 20 to shut down if the door lock mechanism 28 has been engaged for the pre-determined duration of time and the elevator drive 20 receives the position signal from the landing switch 26 indicating the elevator car 12 is away from the specified landing 24.

For example, if the elevator mechanic opens the hoistway doors 15, via the door lock mechanism 28, and the elevator car 12 is away from the landing 24A, it is indicative that the elevator mechanic does not have control of the elevator car 12. It would not be safe for the elevator mechanic to enter the hoistway 18, and as such the elevator drive 20 shuts down to prevent movement of the elevator car 12. In order to bring the elevator car 12 back into operation, the elevator mechanic may reset the access detection mode at the elevator drive 20. In an embodiment, the elevator car 12 may operate at an inspection speed while in the access detection mode. In some embodiments, the access detection mode may not be disabled. It will further be appreciated that an audible or visual warning system (not shown) may be activated when the elevator drive 20 is in the access detection mode.

It will therefore be appreciated that the present embodiments include an elevator drive 20 capable of entering an access detection mode to shut down and prevent movement of the elevator car 12 if the elevator car 12 is not present at a specified landing, and the hoistway door lock mechanism has been engaged longer than a pre-determined duration of time.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed is:

1. A method of controlling movement of an elevator car comprising:

(a) determining whether the elevator car is present at a specified landing;

(b) determining a door lock state based on whether a door lock mechanism has been engaged for a pre-determined duration of time; and (c) entering an access detection mode based in part on whether the elevator car is present at the specified landing and the door lock state.

2. The method of claim 1, wherein step (a) comprises operating an elevator drive to receive a position signal from a landing switch.

3. The method of claim 1, wherein the pre-determined duration of time is greater than or equal to approximately 4 seconds.

4. The method of claim 1 wherein the access detection mode comprises operating the elevator drive to prevent movement of the elevator car if the door lock mechanism has been engaged for the pre-determined duration of time and the elevator drive receives a position signal from the landing switch indicating the car is away from the specified landing.

5. The method of claim 1, wherein the access detection mode may not be disabled.

6. The method of claim 1, wherein the access detection mode comprises operating the elevator car at an inspection speed.

7. An elevator system comprising:

an elevator hoistway including a landing;

a landing switch disposed within the elevator hoistway and located in close proximity to the landing, wherein the landing switch is configured to transmit a position signal;

a hoistway door located at the landing;

a door lock mechanism operably coupled to the hoistway door, wherein the door lock mechanism is configured to transmit a door lock state signal;

an elevator car disposed within the elevator shaft, the elevator car configured to travel within the elevator hoistway; and an elevator drive in communication with the elevator car, the landing switch, and the door lock mechanism, the elevator drive configured to enter an access detection mode based in part on the position signal and the door lock state signal.

8. The elevator system of claim 7, wherein the position signal is indicative of the presence of the elevator car at the landing.

9. The elevator system of claim 7, wherein the door lock state signal is indicative of whether the door lock mechanism has been engaged for a pre-determined duration of time.

10. The elevator system of claim 9, wherein the predetermine duration of time is greater than or equal to approximately 4 seconds.

11. The elevator system of claim 7, wherein the hoistway door further comprises an aperture disposed therein, wherein the aperture is located adjacent to the door lock mechanism.

12. The elevator system of claim 7, wherein the access detection mode may not be disabled.

13. The elevator system of claim 7, wherein the access detection mode comprises operating the elevator car at an inspection speed.

* * * * *